US007107652B2

(12) United States Patent
Thordahl

(10) Patent No.: US 7,107,652 B2
(45) Date of Patent: Sep. 19, 2006

(54) HIGH SPEED FORMER HEAD

(75) Inventor: Jens Erik Thordahl, Rønde (DK)

(73) Assignee: Dan-Web Holding A/S, Risskov (DK)

( * ) Notice: Subject to any disclaimer, the term of this patent is extended or adjusted under 35 U.S.C. 154(b) by 384 days.

(21) Appl. No.: 10/487,353

(22) PCT Filed: Aug. 20, 2002

(86) PCT No.: PCT/DK02/00544

§ 371 (c)(1),
(2), (4) Date: Feb. 20, 2004

(87) PCT Pub. No.: WO03/016622

PCT Pub. Date: Feb. 27, 2003

(65) Prior Publication Data

US 2004/0234638 A1 Nov. 25, 2004

(30) Foreign Application Priority Data

Aug. 20, 2001 (DK) ..... 2001 01232

(51) Int. Cl.
*D01G 25/00* (2006.01)

(52) U.S. Cl. ..... 19/308; 19/161.1

(58) Field of Classification Search ..... 19/144, 19/145.5, 148, 296, 299–301, 304, 305, 308, 19/161.1; 264/516, 518; 425/83.1
See application file for complete search history.

(56) References Cited

U.S. PATENT DOCUMENTS 2,714,749 A 8/1955 Clark et al.
2,720,005 A 10/1955 Clark et al.
2,738,556 A 3/1956 Anderson
2,738,557 A 3/1956 Anderson
2,827,668 A 3/1958 Clark
2,931,076 A 4/1960 Clark
2,940,418 A 6/1960 Penrod et al.
4,352,649 A * 10/1982 Jacobsen et al. ..... 425/83.1
4,389,175 A 6/1983 Sakschek
4,624,819 A 11/1986 Hartog et al.
4,640,810 A 2/1987 Laursen et al.
4,697,542 A 10/1987 Kohler et al.

FOREIGN PATENT DOCUMENTS

GB 2141150 12/1984
WO WO 81/02031 7/1981
WO WO 87/01403 3/1987
WO WO 01/54873 8/2001

* cited by examiner

*Primary Examiner*—Gary L. Welch
(74) *Attorney, Agent, or Firm*—James Creighton Wray

(57) ABSTRACT

A former head for dry forming fibrous tissue in which a fiber material is mixed with air introduced to at least one rotating drum in a former head by injection. The drum is provided internally with means for fluidizing the injected fibers simultaneously, enabling higher production capacity and an increased distribution quality of the fibers. This former head has high capacity and an increased width, preferably over four meters, which avoids natural oscillations in the needle rollers as they are substituted by slotted air nozzles. The nozzles extend along a whole length of the drum and have adjustable nozzle lips to regulate the amount of air and direction of the air-flow blown through the perforations of the drum. Surprisingly, the capacity of the former head is markedly higher than conventional devices and distribution quality also is markedly better than by high-speed operation of traditional machines.

6 Claims, 2 Drawing Sheets

HIGH SPEED FORMER HEAD

This application claims the benefit of Danish Application No. PA 2001 01232 filed Aug. 20, 2001 and PCT/DK02/00544 filed Aug. 20, 2002.

The present invention concerns a former head of the kind used for dry forming of fibrous tissue, where a fibre material mixed with air is conducted to at least one rotating perforated drum in a former head by injection, said drum is provided internally with fluidising means constituted by air nozzle means arranged longitudinally of the drum on at least one air conveying tube with substantially with the same length as the drum and arranged for fluidising the fibres.

From the industry and from WO-A-81/02031 there are known former head where a mixture of fibres and air is injected into the ends of rotating perforated cylinders. Inside the cylinders, the so-called drums, there is mounted a needle roller which is also rotatable, keeping the individual fibres afloat so that clotting does arise before the fibres are sucked by vacuum through the perforation in the drum and is fixed on an former wire running underneath. Alternatively to the needle roller it has also been proposed to use a pipe provided with nozzles for directing an air jet towards the inside of the perforated drum in order to obtain an out throwing and agitating effect on the fibre material.

In the known former head there are two drums, where one is rotated in the same direction as the movement of the former wire and the other is counter rotated in relation thereto. The needle rollers in the drums are rotating against the direction of rotation of the respective drums.

The traditional drums and needle rollers, however, have the drawback that they, when rotated with high speed, are brought in oscillations influencing the distribution quality of the fibres. However, these natural oscillations only arise when the speed of the drum or the needle roller becomes too high, or the length of the drums and needle rollers becomes too great. In order to avoid this problem, there is possibility of constructing drum or roller with larger diameter in order thereby to move the critical speed for natural oscillations. This solution is, however, not good, since the machine hereby becomes unnecessarily space consuming and expensive. When using the nozzles to create air jets a problem occur. Hereby the fibres will be pressed directly against the drum which will hinder a fluidisation and hinder a rotating movement of the fibres through the drum.

On former heads having a width of about four meters, it is normal that needle rollers are rotated with a speed of 700–800 rpm, but for achieving the desired capacity it is necessary with a rotational speed of 1200–1400 rpm. The drums are normally rotated with a speed of about 200 rpm.

If a former head is to have an active width of about 4 m, the needle rollers cannot be rotated with the desired speed without the arising of natural oscillations, causing reduction of the quality of the dry shaped product.

In U.S. Pat. No. 2,720,005 there is disclosed a former head in which there is mounted one or more slotted air nozzles. This former head is non-rotating, i.e. that the drum is stationary and the drum only has apertures/perforations in an area at the bottom through which the fibres are led to an underlying former wire. In order to keep the fibres fluidised and free from entanglement and cluttering there are mounted slotted air nozzles, i.e. air nozzles with slotted nozzle apertures, which by a tangential air flow creates rotation in the fibres, which in this way are prevented from being entangled and aggregation. Furthermore, there may be mounted a slotted air nozzle in radial direction, introducing air into the drum, whereby lumps of fibre may more easily be separated. This kind of former head thus do not differ appreciably from the above former heads with rotating drums and with internally rotating rollers. Furthermore, a former head according to U.S. Pat. No. 2,720,005 is made for forming narrow webs and is not suited for dry formation of fibrous web with a width up to and more than four meters.

SUMMARY OF THE INVENTION

It is the purpose with a former head according to the invention to indicate an apparatus and a method whereby there is achieved a higher production capacity, simultaneously achieving an increased distribution quality of the fibres, and where there is possibility of having a former head with high capacity and an increased width, preferably more than four meters.

According to the invention this is obtained with a former head being particular in that said nozzle means are constituted by a slotted air nozzle extending longitudinally of the drum and with substantially with the same length as the drum and having adjustable nozzle lips preferably directed towards the internal surface of the drum and that the longitudinal conveying tube of the slotted air nozzle is made with perforations through which the drum is supplied an amount of air, and where the conveying tube is equipped with control means for regulating the air flow through the perforations. The slotted air nozzle injects air from the interior of the drum through the perforations of the drum, and with the adjustable nozzle lips, the amount of air and direction of the air flow may be regulated.

In order to keep the fibres in the drum fluidised in the drum, the longitudinal conveying tube of the slotted air nozzle is made with perforations through which the drum is supplied an amount of air, and where the conveying tube is equipped with control means for regulating the air flow through the perforations.

The slotted air nozzles are disposed in the lower half of the perforated and in immediate vicinity of the internal side of the drum, where nozzle lips of the slotted air nozzle are directed towards the internal wall of the drum in such a way that the air flow presses the fibres through the perforations of the drum and down towards the former wire.

With the above measures there is achieved the surprising effect that the capacity of the former apparatus is markedly higher than with the prior art, and that the distribution quality is also markedly better that n by high-speed operation with traditional machines. Furthermore, by a former head according to the invention it is possible to make a dry formed fibrous web with a width which preferably is greater than 4 m.

Alteratively, the nozzle lips may also be adjusted for loosening the fibres from the internal wall of the drum. This may be achieved by setting the nozzle so that injection is performed partially tangentially with the rotating aid perforated drum wall.

An embodiment of a former head according to the invention has at least one rotating and perforated drum, preferably a set consisting of two drums rotating in direction following the former wire, which provides for a high distribution quality on thin dry formed products:

A former head according to the invention may be with at least two drums where at least one drum contains a slotted air nozzle and where a second drum contains a traditional or modified needle roller. Thus there is possibility of combining the use of slotted air nozzles in the former head with traditional or modified needle rollers. With this configuration, the drum with slotted air nozzle can supply fibres with increased capacity and uniformity while the drum with needle roller may be operated in a normal way and consequently with lesser capacity.

In a second embodiment of a former head according to the invention may be with at least one drum containing at lest one slotted air nozzle and at least one needle roller.

With this embodiment there may, under certain circumstances be achieved an optimal operation of a former head according to the invention.

A further measure for optimal operation of a former head according to the invention is to provide the former head with a screen between the sides of the former head and the drums as well a between the drums. With this screening is achieved a higher efficiency of the vacuum unit creating the under pressure that fixes the fibres on the former wire since suction of "false air" is prevented by screening.

In the following, the invention is described with reference to the drawing, which, without being limiting, shows a preferred embodiment of a former head according to the invention, where:

DETAILED DESCRIPTION OF THE PREFERRED EMBODIMENTS

Figure 1:
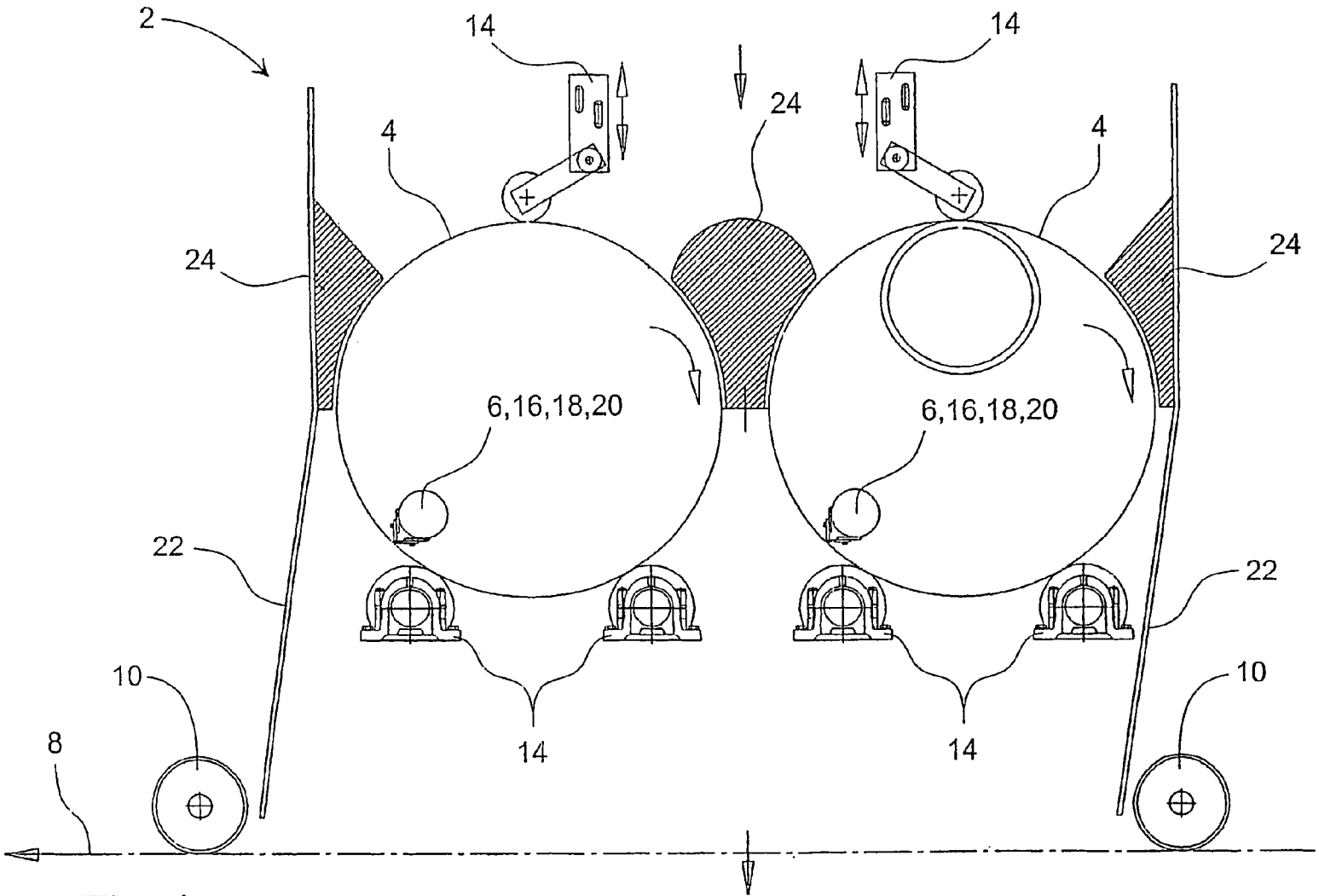
FIG. 1 shows a sectional view of a former head as seen from the side.

In FIG. 1, the former head 2 is seen from the side, where drums 4 and slotted air nozzles 6 are arranged above the former wire 8. At the in 2, guide rollers 10 are seen, mounted immediately above the perforated former wire 8. Under the former wire 8 there is a not shown source of vacuum inducing a sucking action down through the former head 2. This sucking action combined with the air supplied via the slotted air nozzle 6 provides that the fibres are brought to form a dry formed product, e.g. a paper material, on the former wire 8. The drums 4 are rotated in the same direction as the direction of movement of the former wire 8 by means of drum moving means 14, and in the lowermost part of the drum there is disposed an slotted air nozzle 6 consisting of a conveying tube 16 provided with a set of adjustable nozzle lips 18. This slotted air nozzle 6 may be adjusted by moving the lips 18 in relation to each other, but also the distance from lip 18 to drum 4 may be regulated by the adjusting means 20. At the sides 22 in the former head 2 there is mounted a screen 24 between side 22 and drum 4, the purpose of which is to ensure an optimal utilisation of the vacuum source used for fixing the fibres. Also, between the two drums 4 there is mounted such a screen 24. The air supplied to the slotted air nozzle 6 may be supplied at the end of the slotted air nozzle 6, but may also be introduced at one or more positions along the length of the slotted air nozzle 6.

Figure 2:
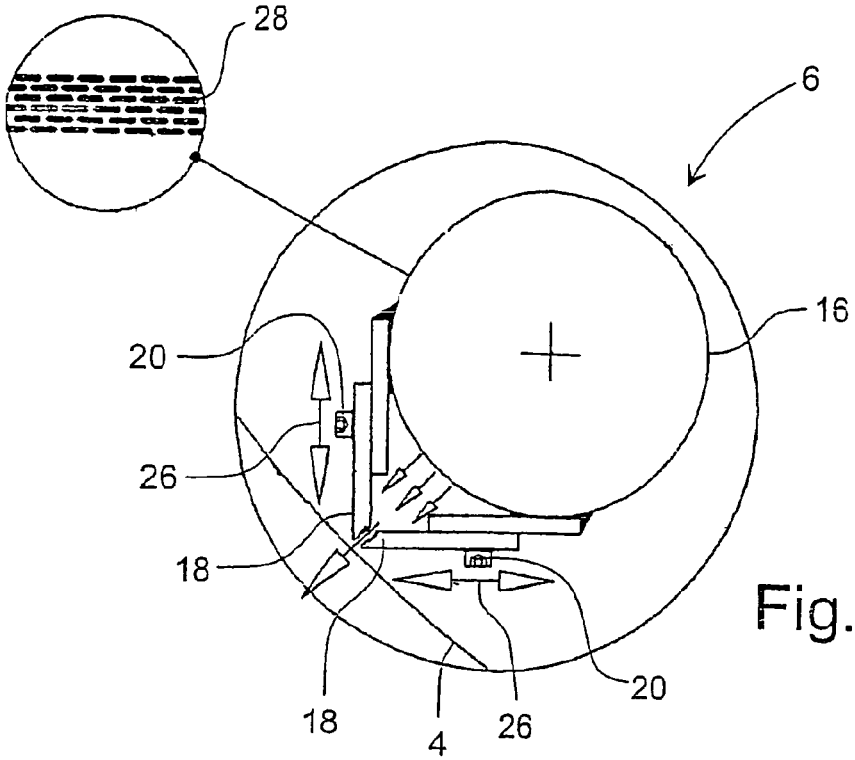
FIG. 2 shows a cross-section of an slotted air nozzle as seen from the end.

FIG. 2 shows in detail a cross-section of the same slotted air nozzle 6 as shown in FIG. 1. Here is clearly seen how the air flows out between the two nozzle lips 18 and is blown out through the wall of the drum 4. It is also shown how the two nozzle lips 18 are adjustable in the directions of the two double arrows 26 by means of adjusting means 20. Furthermore there is an enlarged detail showing that the conveying tube 16 in the slotted air nozzle 6 may be made of a perforated material 28 so that the fibres in the former head 2 may be kept fluidised according to wish until the distribution of fibres is with sufficient uniformity. The conveying tube 16 may in a not shown embodiment be made with a damper system providing the option of regulating the air flow flowing in through the slotted air nozzle 6.

Figure 3:
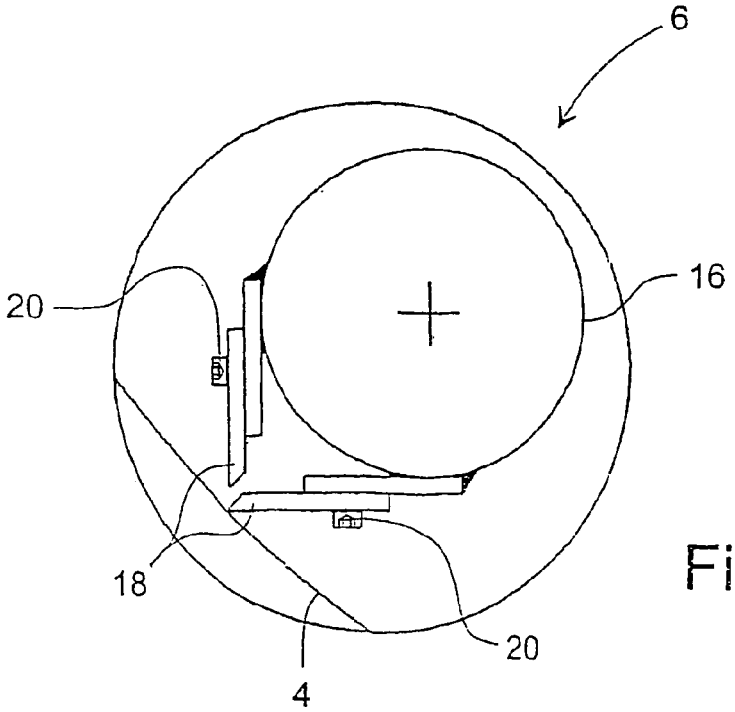
FIG. 3 shows an example of the setting of the nozzle lips.

In FIG. 3 is seen the same cross-section of a slotted air nozzle 6 as in FIG. 2, but here with the nozzle lips 18 set in an asymmetric position.

The invention claimed is:

1. A former head of the kind used for dry forming of fibrous tissue, where a fiber material mixed with air is conducted to at least one rotating perforated drum in a former head by injection, said drum is provided internally with fluidising means constituted by air nozzle means arranged longitudinally of the drum on at least one air conveying tube with substantially with the same length as the drum and arranged for fluidising the fibers injected, wherein said nozzle means are constituted by a slotted air nozzle extending longitudinally of the drum and with substantially with the same length as the drum and having adjustable nozzle lips preferably directed towards the internal surface of the drum and that the longitudinal conveying tube of the slotted air nozzle is made with perforations through which the drum is supplied an amount of air, and where the conveying tube is equipped with control means for regulating the air flow through the perforations.

2. A former head according to claim 1, wherein an slotted air nozzle is disposed in the lower half of the perforated drum and in immediate vicinity of the internal side of the drum, where the nozzle lips of the slotted air nozzle are directed towards the internal wall of the drum.

3. A former head according to claim 1, wherein the former head includes at least one set of drums consisting of two perforated drums, where the drums are rotating in a direction following the former wire.

4. A former head according to claim 1, wherein the former head is provided with at least two drums, where at least one drum contains one slotted air nozzle and where a second drum contains a traditional or modified needle roller.

5. A former head according to claim 1, wherein one drum contains at least one slotted air nozzle and at least one needle roller.

6. A former head according to claim 1, wherein the former head is provided with a screen between the sides of the former head and the drums as well as between the drums.

* * * * *